US011168591B1

(12) United States Patent
Bulzacchelli et al.

(10) Patent No.: US 11,168,591 B1
(45) Date of Patent: Nov. 9, 2021

(54) HYDRAULICALLY-ACTUATED VARIABLE CAMSHAFT TIMING (VCT) PHASER ASSEMBLY WITH AIR VENTING

(71) Applicant: BorgWarner, Inc., Auburn Hills, MI (US)

(72) Inventors: John C. Bulzacchelli, Ithaca, NY (US); Michael L. Smart, Groton, NY (US)

(73) Assignee: BORGWARNER, INC., Auburn Hills, MI (US)

( * ) Notice: Subject to any disclaimer, the term of this patent is extended or adjusted under 35 U.S.C. 154(b) by 0 days.

(21) Appl. No.: 16/941,839

(22) Filed: Jul. 29, 2020

(51) Int. Cl.
*F01L 1/34* (2006.01)
*F01L 1/344* (2006.01)

(52) U.S. Cl.
CPC ..... *F01L 1/3442* (2013.01)

(58) Field of Classification Search
CPC ..... F01L 1/3442
See application file for complete search history.

(56) References Cited

U.S. PATENT DOCUMENTS 6,745,735 B2 * 6/2004 Smith ..... F01L 1/3442 123/90.15
2013/0180481 A1 * 7/2013 Kato ..... F01L 1/3442 123/90.15
2018/0172116 A1 6/2018 Freemantle et al.

FOREIGN PATENT DOCUMENTS

JP 09250310 A * 9/1997 ..... F01L 1/3442

OTHER PUBLICATIONS

Abstract of the above lised reference: JP-09250310-A, Sep. 1997.*

* cited by examiner

*Primary Examiner* — Zelalem Eshete
(74) *Attorney, Agent, or Firm* — Reising Ethington P.C.

(57) ABSTRACT

A hydraulically-actuated variable camshaft timing (VCT) phaser assembly is employed for use in an automotive internal combustion engine. The VCT phaser assembly has a housing, a rotor, a first plate, a second plate, and a control valve. The rotor is situated within the housing, and a plurality of chambers are established between the rotor and housing. The first plate is situated on one side of the housing and rotor, and the second plate is situated on an opposite side of the housing and rotor. One or more air vents reside in one or more of the housing, rotor, first plate, second plate, or control valve. Air separated from hydraulic fluid in the VCT phaser assembly amid use and that makes its way to the air vent(s) can escape the VCT phaser assembly.

13 Claims, 11 Drawing Sheets

HYDRAULICALLY-ACTUATED VARIABLE CAMSHAFT TIMING (VCT) PHASER ASSEMBLY WITH AIR VENTING

TECHNICAL FIELD

The present application relates to variable camshaft timing (VCT) technologies equipped in internal combustion engines.

BACKGROUND

In automobiles, internal combustion engines (ICEs) use one or more camshafts to open and close intake and exhaust valves in response to cam lobes selectively actuating valve stems as the camshaft(s) rotate and overcome the force of valve springs that keep the valves seated. The shape and angular position of the cam lobes can impact the operation of the ICE. In the past, the angular position of the camshaft relative to the angular position of the crankshaft was fixed. But it is now possible to vary the angular position of the camshaft relative to the crankshaft using variable camshaft timing (VCT) technologies. VCT technologies can be implemented using VCT devices (sometimes referred to as camshaft phasers) that change the angular position of the camshaft relative to the crankshaft. These camshaft phasers are often hydraulically-actuated.

Hydraulically-actuated VCT devices typically include a housing, a rotor, inner and outer plates, and a control valve, among other possible components. Hydraulic fluid in the form of oil is fed in and out of chambers established among the housing and rotor and plates in order to carry out advance and retard functionalities of the VCT devices. The control valve works to manage the oil as it flows in and out of the chambers and in response to instructions from an engine control unit (ECU).

SUMMARY

In one implementation, a hydraulically-actuated variable camshaft timing (VCT) phaser assembly may include a housing, a rotor, a first plate, a second plate, and a center bolt body. The rotor is situated within the housing. The first plate is situated on a first side of the housing and rotor, and the second plate is situated on a second side of the housing and rotor. The VCT phaser assembly may further include one or more air vents. The air vent(s) resides in the housing, the rotor, the first plate, the second plate, or the center bolt body, or in a combination of these components. The air vent(s) is located at a center of rotation region of the particular component(s) in which it resides. The center of rotation region is with respect to rotational motion of the hydraulically-actuated VCT phaser assembly. Amid use, air brought to the center of rotation region and received in the air vent(s) escapes hydraulic fluid that remains in the hydraulically-actuated VCT phaser assembly.

In another implementation, a hydraulically-actuated variable camshaft timing (VCT) phaser assembly may include a housing, a rotor, multiple chambers, a first plate, and a second plate. The chambers are established between the housing and the rotor. The first plate is situated on a first side of the chambers, and the second plate is situated on a second side of the chambers. The VCT phaser assembly may further include multiple vents. The air vents reside in the first plate, in the second plate, or in both of the first and second plates. The air vents are in fluid communication with the chambers, and are located at or near a hub of the rotor. Amid use of the hydraulically-actuated VCT phaser assembly, air separated from hydraulic fluid in the chambers and received in the air vents exits the chambers.

In yet another implementation, a hydraulically-actuated variable camshaft timing (VCT) phaser assembly may include a housing, a rotor with a hub, multiple chambers, multiple ports, a first plate, and a second plate. The chambers are established between the housing and the rotor. The ports reside in the rotor's hub and fluidly communicate with the chambers. The first plate is situated on a first side of the chambers, and the second plate is situated on a second side of the chambers. The VCT phaser assembly may further include multiple vents. The air vents reside in the rotor's hub. The air vents are in fluid communication with some or more of the ports. Amid use of the hydraulically-actuated VCT phaser assembly, air separated from hydraulic fluid in the VCT phaser assembly and received in the air vents exits the ports by way of the air vents.

DETAILED DESCRIPTION

Figure 1:
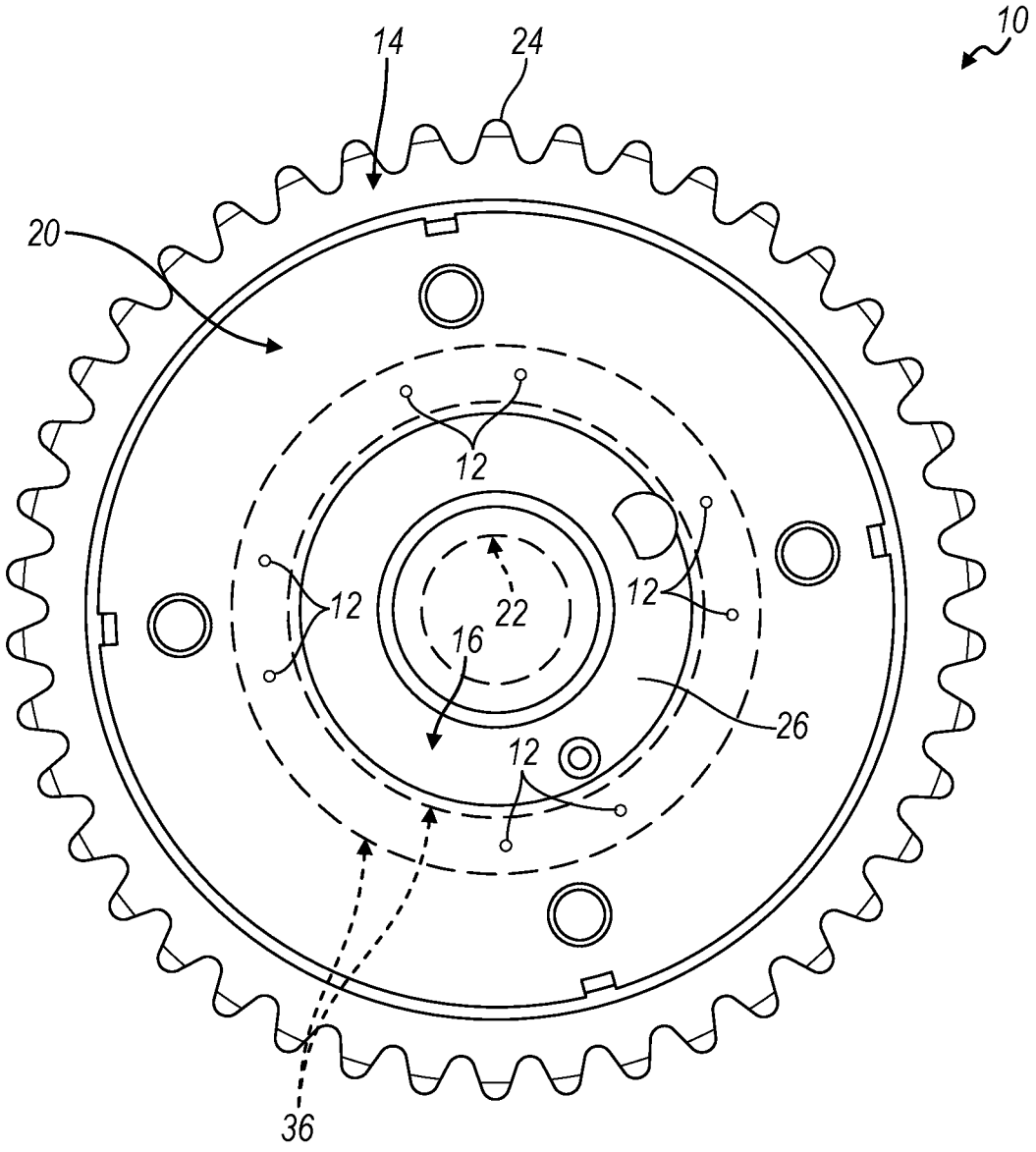
FIG. 1 depicts a first embodiment of a hydraulically-actuated variable camshaft timing (VCT) phaser assembly, this embodiment having air vents in an outer plate of the VCT phaser assembly.

Embodiments of a hydraulically-actuated variable camshaft timing (VCT) phaser assembly 10 with air venting are presented in the figures and detailed in this description. The VCT phaser assembly 10 is, in general, equipped in automotive internal combustion engine (ICE) applications. Unlike past VCT devices, one or more air vents 12 reside in one or more components of the VCT phaser assembly 10 to remove air from hydraulic fluid in the form of oil circulating in the VCT phaser assembly 10. Oil that is too heavily aerated can exhibit instability and tends to become compressible in nature. By having air removed, the VCT phaser assembly 10 has enhanced hydraulic stiffness in its oil and hence has an improved overall system stability and a more effective and responsive performance. Further, as used herein, the terms axially, radially, and circumferentially, and their related grammatical forms, are used in reference to the generally circular and cylindrical shape of the shown VCT phaser assembly and some of its components. In this sense, axially refers to a direction that is generally along or parallel to a central axis of the circular and cylindrical shape, radially refers to a direction that is generally along or parallel to a radius of the circular and cylindrical shape, and circumferentially refers to a direction that is generally along or in a similar direction as a circumference of the circular and cylindrical shape.

The air venting and air vent(s) 12 can be incorporated in VCT phaser assemblies of various designs and constructions and components. One example VCT phaser assembly is presented in the figures. Here, the VCT phaser assembly 10 generally includes as its main components a housing 14, a rotor 16, a first or inner plate 18, a second or outer plate 20, and a center bolt body 22. The housing 14 can have a camshaft sprocket 24 or a pulley for engagement with an endless loop such as a chain or belt that further engages a crankshaft sprocket or other component of the accompanying ICE. By way of the engagement, rotation is transmitted from the ICE and to the housing 14, causing the housing 14 to rotate. The rotor 16 has a hub 26 and multiple vanes 28 extending radially-outwardly from the hub 26. The rotor 16 is connected to a camshaft so that rotation of the rotor 16 causes rotation of the camshaft. Multiple ports 30 reside in the hub 26 and span radially-outwardly from an inboard surface 32 of the hub 26 to an outboard surface 33 of the hub 26. Fluid communication is provided therebetween via the ports 30. The first plate 18 is mounted on a first axial side of the housing 14 and rotor 16, and the second plate 20 is mounted on a second and opposite axial side of the housing 14 and rotor 16. The mounting can be carried out by bolting.

Multiple fluid chambers 34 are established by confronting surfaces among the housing 14, rotor 16, first plate 18, and second plate 20. The fluid chambers 34 are advance and retard fluid chambers that receive pressurized oil via an advance line and retard line amid use of the VCT phaser assembly 10. The oil is introduced to the VCT phaser assembly 10 via a source of the ICE and is pressurized by a pump. The fluid chambers 34 directly and immediately fluidly communicate with the ports 30. Oil travels through the ports 30 as oil enters and exits the advance and retard fluid chambers. The center bolt body 22, depicted schematically in FIG. 1, is part of a control valve that helps manage the flow of oil to and from the advance and retard fluid chambers in order to effect advance and retard functionalities of the VCT phaser assembly 10, as commanded by an engine control unit (ECU). Among its other possible components, the VCT phaser assembly 10 can further include a lock pin assembly and an actuator such as a variable force solenoid (VFS) actuator. The lock pin assembly would be used to maintain the angular position of the rotor 16 relative to the housing 14, and the actuator moves a spool of the control valve back and forth against the bias of a spring.

It has been found that air makes its way into the oil as the oil circulates through the larger system and upstream and downstream of the subject VCT phaser assembly. Leak paths that introduce unwanted amounts of air into the oil can exist in certain components due to manufacturing tolerances, and can develop over time and use in certain components. It has been shown that oil imbued with large amounts of air exhibits instability and becomes compressible in nature and, in a sense, has a so-called springy effect. The accompanying camshaft can consequently have a certain degree of oscillation and can develop a timing issue. Noise, vibration, and harshness (NVH) issues can also arise, as well as durability issues. Ultimately, the VCT phaser assembly can exhibit diminished effectiveness and performance. The air venting and air vent(s) 12 are intended to remove the unwanted air and purge the VCT phaser assembly 10 and particularly its fluid chambers 34 of the air. The VCT phaser assembly 10, with air vented, has minimized hydraulic compressibility and thus has enhanced hydraulic stiffness in its oil. An improved overall system stability and a more effective and responsive performance results.

Figure 2:
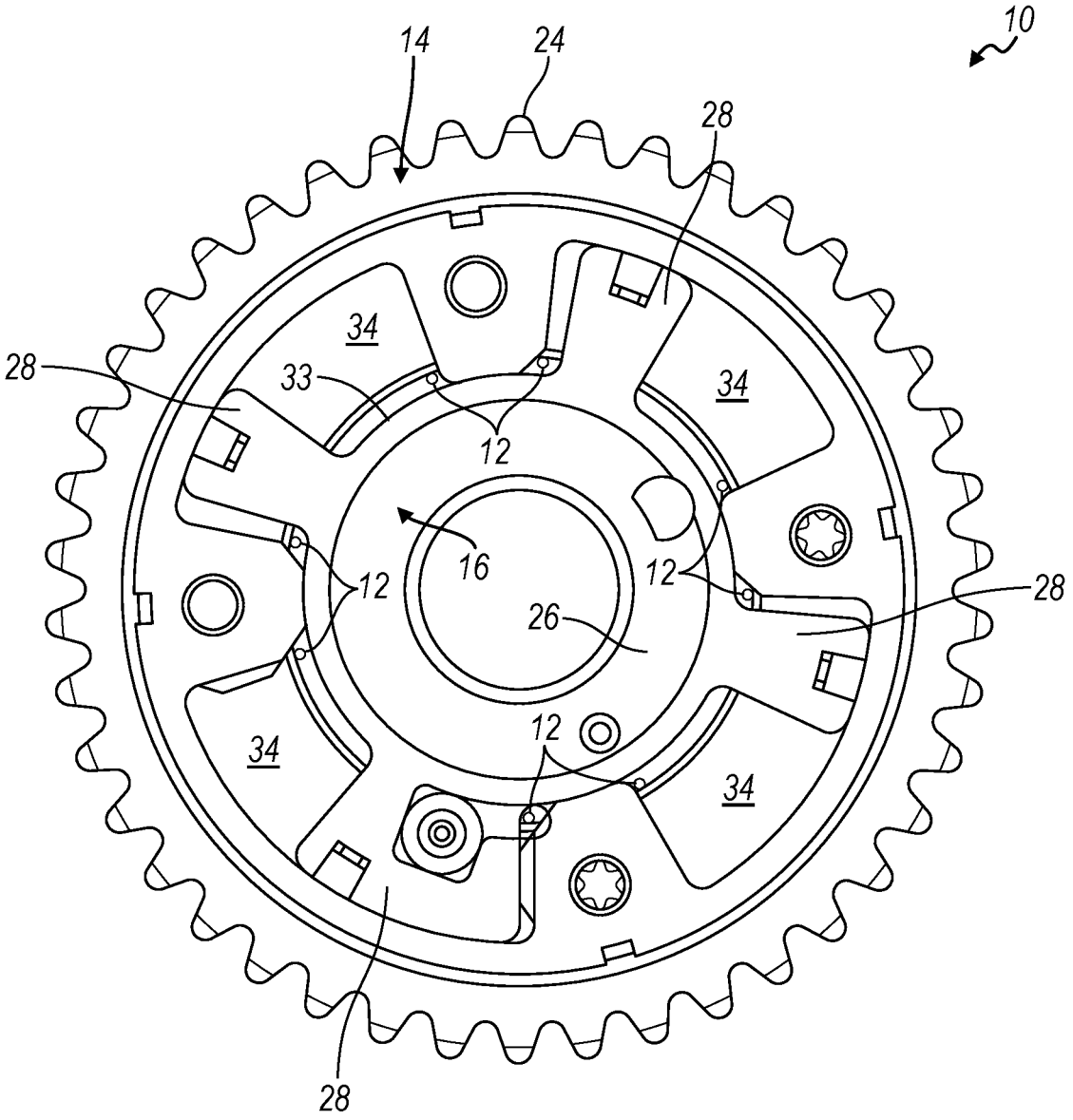
FIG. 2 depicts the first embodiment, with the outer plate being transparent for demonstrative purposes.

FIGS. 1 and 2 present a first embodiment of the VCT phaser assembly 10 with air venting and the air vents 12. In this embodiment multiple individual air vents 12 reside in the outer plate 20. The air vents 12 span wholly through the structure of the outer plate 20 in the axial direction relative to the generally circular shape of the outer plate 20. There is a total of eight individual air vents 12—two fluidly communicating with each fluid chamber 34, one with the advance fluid chamber side and one with the retard fluid chamber side. Here, as well as in other embodiments, the exact quantity of individual air vents can vary depending on the anticipated mixture of air in oil and the desired degree of venting for the particular VCT phaser assembly. For example, there could be a single air vent for each fluid chamber, or there could be multiple air vents for each fluid chamber; still, not all of the fluid chambers need necessarily directly fluidly communicate with an air vent. Furthermore, formation of the air vents 12 in the particular component can vary. In the first embodiment, the air vents 12 can be formed by laser drilling orifices in the outer plate 20, by drilling orifices in the outer plate 20, or by another preparation and formation technique.

The precise size of the air vents 12 can also vary. Again here, the precise size of the air vents 12 can depend on the anticipated mixture of air in oil and the desired degree of venting for the particular VCT phaser assembly. In one example, the air vents 12 can each have a diameter of approximately 0.10 millimeters (mm). In other examples the air vents 12 can each have a diameter that ranges between approximately 0.1 mm and 0.5 mm, or that is less than approximately 0.5 mm in diameter. Still, in certain examples the air vents 12 can each have a total cross-sectional area ranging between approximately 0.01 $mm^2$ and 1.1 $mm^2$. Other values are possible for these dimensions. However sized, the air vents 12 are situated at a location that is suitable for effecting air removal from the oil and purging of air. In the embodiment of FIGS. 1 and 2, the air vents 12 are located at a center of rotation region 36. The center of rotation region 36 is established here relative to the rotational motion of the VCT phaser assembly 10 and particularly relative to that of the outer plate 20 and its positional relationship with the hub 26, and is approximated and represented in FIG. 1 by the broken-line circles depicted. The center of rotation region 36 coincides with a radially-inboard region of the fluid chambers 34 and resides adjacent the hub 26. Air removal and purging of air is effective and efficient at the center of rotation region 36, according to an embodiment. Furthermore, the air vents 12 are located at corners or corner regions of the fluid chambers 34; here a single air vent 12 is located at each corner of each of the fluid chambers 34. Moreover, with respect to their particular location on the outer plate 20, the air vents 12 reside at circumferential and radial locations to fluidly communicate with the established fluid chambers 34.

Air is pulled away and somewhat separated from the oil due to the density difference between the air and oil, the relative buoyancy of the air, and due to centrifugal forces experienced by the air and oil amid rotational motion of the VCT phaser assembly 10 during use. As the VCT phaser assembly 10 rotates, centrifugal forces exerted cause the relatively lighter air to be naturally drawn toward the center of rotation region 36. Air and air/oil mixture that makes its way to the corner regions and to the air vents 12 can escape and exit the fluid chambers 34. From there, any oil that exits can be drained to an oil pan of the ICE. This venting of air is incorporated into the normal operating modes of the VCT phaser assembly 10 and hence can occur, for instance, while the VCT phaser assembly 10 is carrying out its advance and retard functionalities. In other words, no additional or dedicated operating mode need be introduced or employed to effect air venting.

Figure 3:
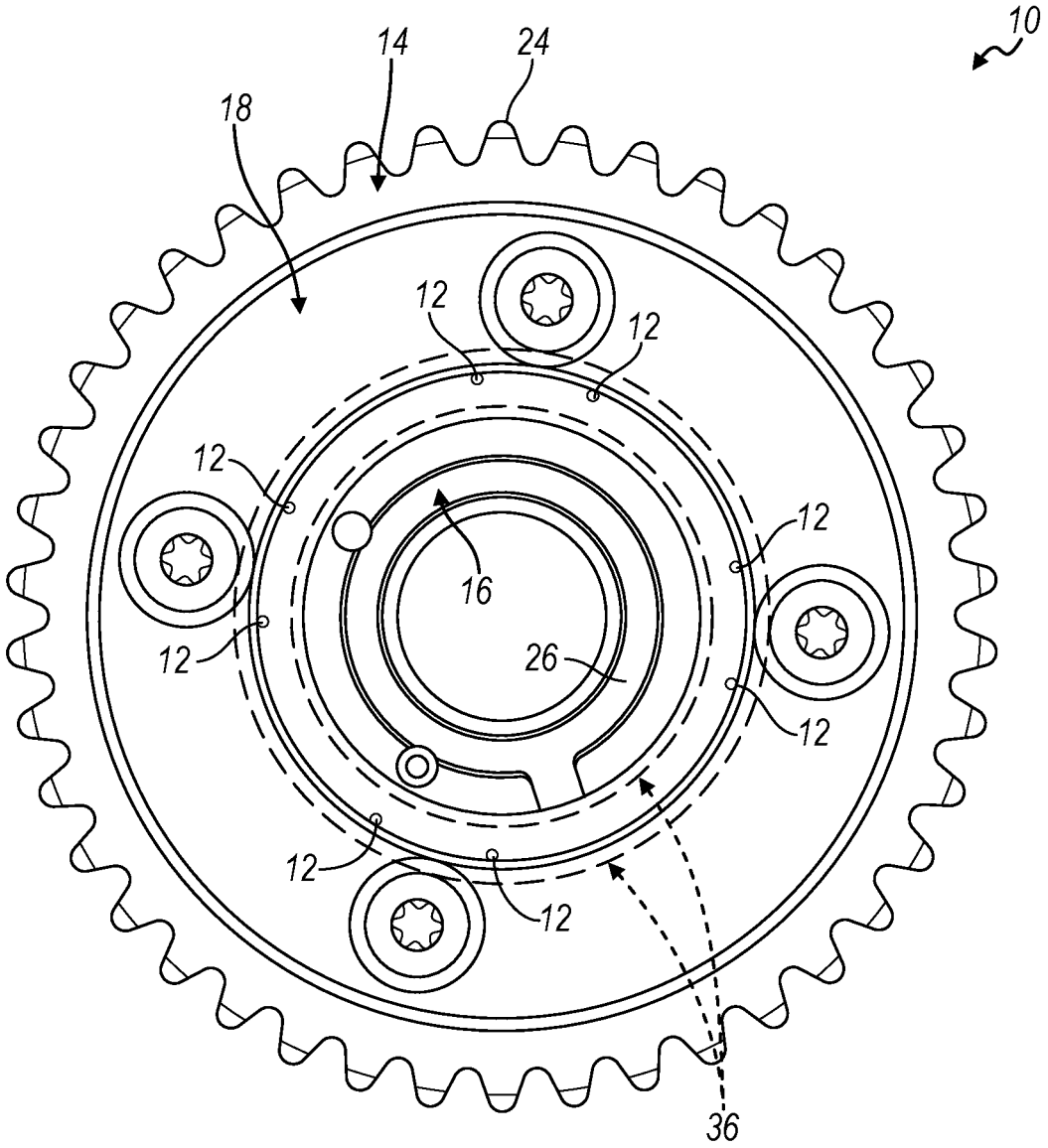
FIG. 3 depicts a second embodiment of the hydraulically-actuated VCT phaser assembly, this embodiment having air vents in an inner plate of the VCT phaser assembly.
Figure 4:
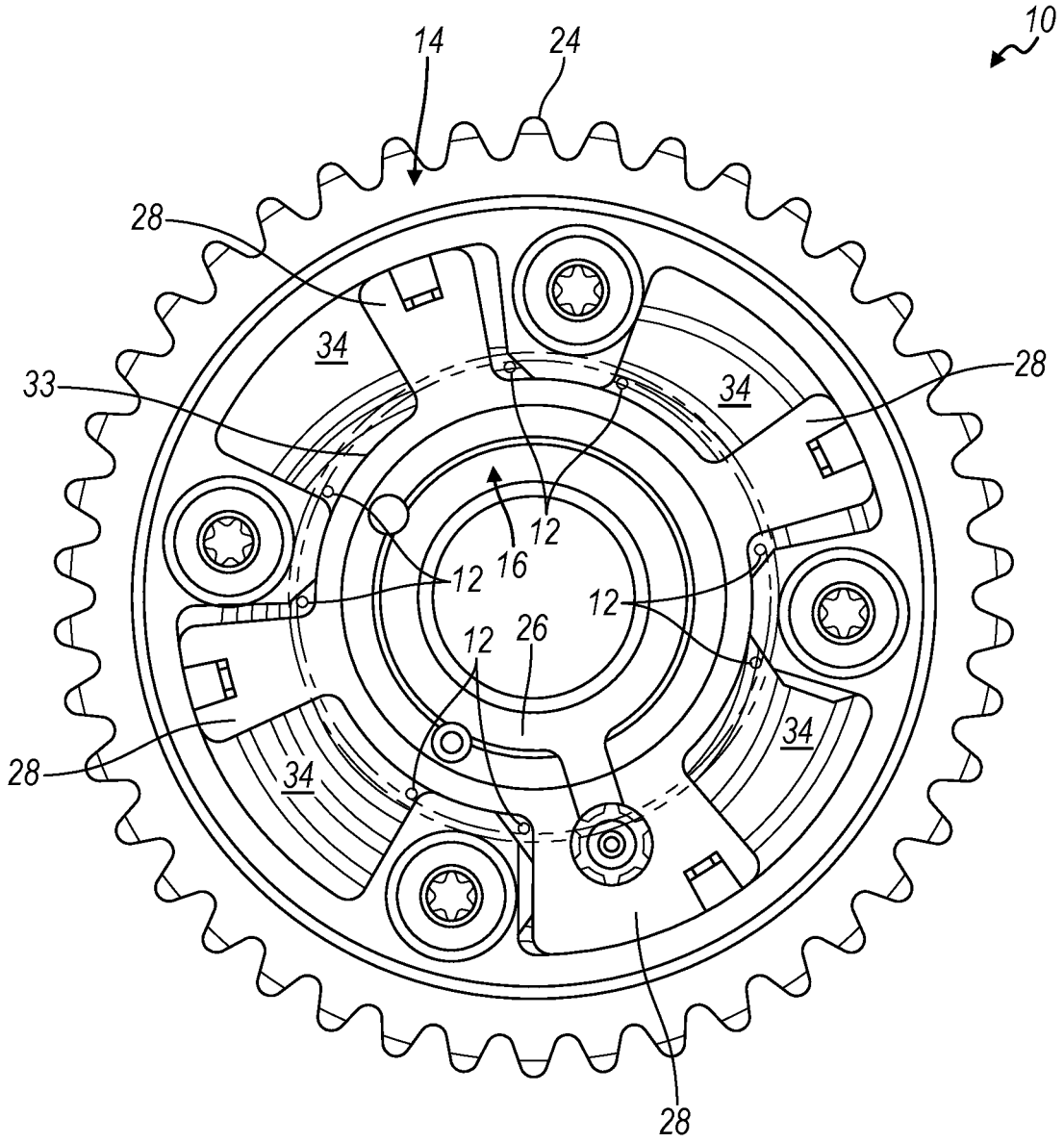
FIG. 4 depicts the second embodiment, with the inner plate being transparent for demonstrative purposes.

FIGS. 3 and 4 present a second embodiment of the VCT phaser assembly 10 with air venting and the air vents 12. Much of the description of the air vents 12 of the first embodiment fully applies here in the second embodiment, and may not be repeated. In the second embodiment multiple individual air vents 12 reside in the inner plate 18. The air vents 12 span wholly through the structure of the inner plate 18 in the axial direction relative to the generally circular shape of the inner plate 18. Like before, there is a total of eight individual air vents 12—two fluidly communicating with each fluid chamber 34, one with the advance fluid chamber side and one with the retard fluid chamber side. Similarly, the exact quantity of individual air vents can vary depending on the anticipated mixture of air in oil and the desired degree of venting for the particular VCT phaser assembly. Furthermore, in the second embodiment, the air vents 12 can be formed by laser drilling orifices in the inner plate 18, by drilling orifices in the inner plate 18, or by another preparation and formation technique.

Likewise, as before, the precise size of the air vents 12 can vary and can depend on the anticipated mixture of air in oil and the desired degree of venting for the particular VCT phaser assembly. In one example, the air vents 12 can each have a diameter of approximately 0.10 mm. In other examples the air vents 12 can each have a diameter that ranges between approximately 0.1 mm and 0.5 mm, or that is less than approximately 0.5 mm in diameter. Still, in certain examples the air vents 12 can each have a total cross-sectional area ranging between approximately 0.01 $mm^2$ and 1.1 $mm^2$. Other values are possible for these dimensions. However sized, the air vents 12 are situated at a location that is suitable for effecting air removal from the oil and purging of air. In this second embodiment too, the air vents 12 are located at the center of rotation region 36. The center of rotation region 36 is established here relative to the rotational motion of the VCT phaser assembly 10 and particularly relative to that of the inner plate 18 and its positional relationship with the hub 26, and is approximated and represented in FIG. 3 by the broken-line circles depicted. The center of rotation region 36 coincides with a radially-inboard region of the fluid chambers 34 and resides adjacent the hub 26. Furthermore, the air vents 12 are located at corners or corner regions of the fluid chambers 34; here a single air vent 12 is located at each corner of each of the fluid chambers 34. Moreover, with respect to their particular location on the inner plate 18, the air vents 12 reside at circumferential and radial locations to fluidly communicate with the established fluid chambers 34.

Figure 5:
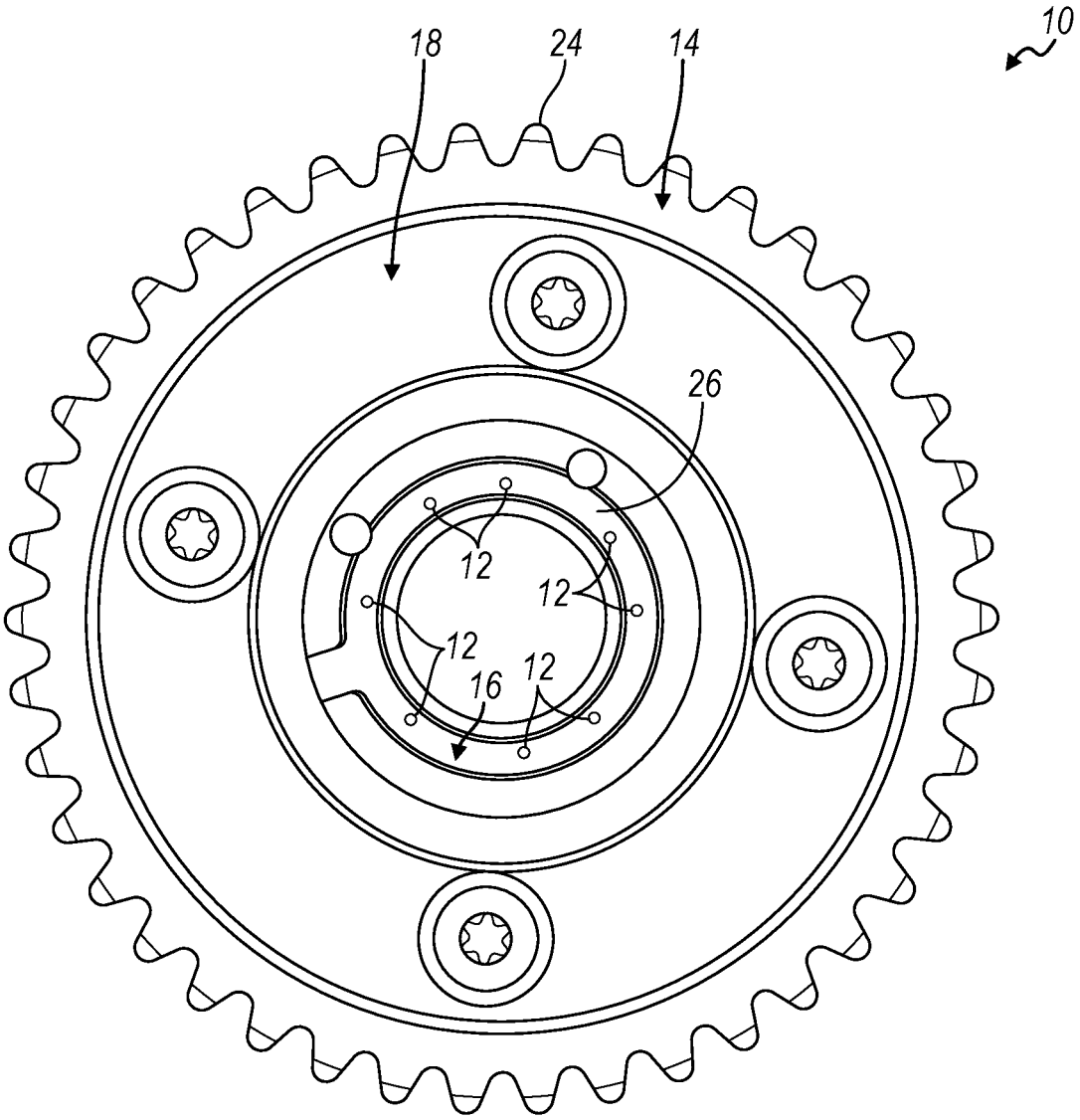
FIG. 5 depicts a rear view of a third embodiment of the hydraulically-actuated VCT phaser assembly, this embodiment having air vents in a rotor of the VCT phaser assembly.
Figure 6:
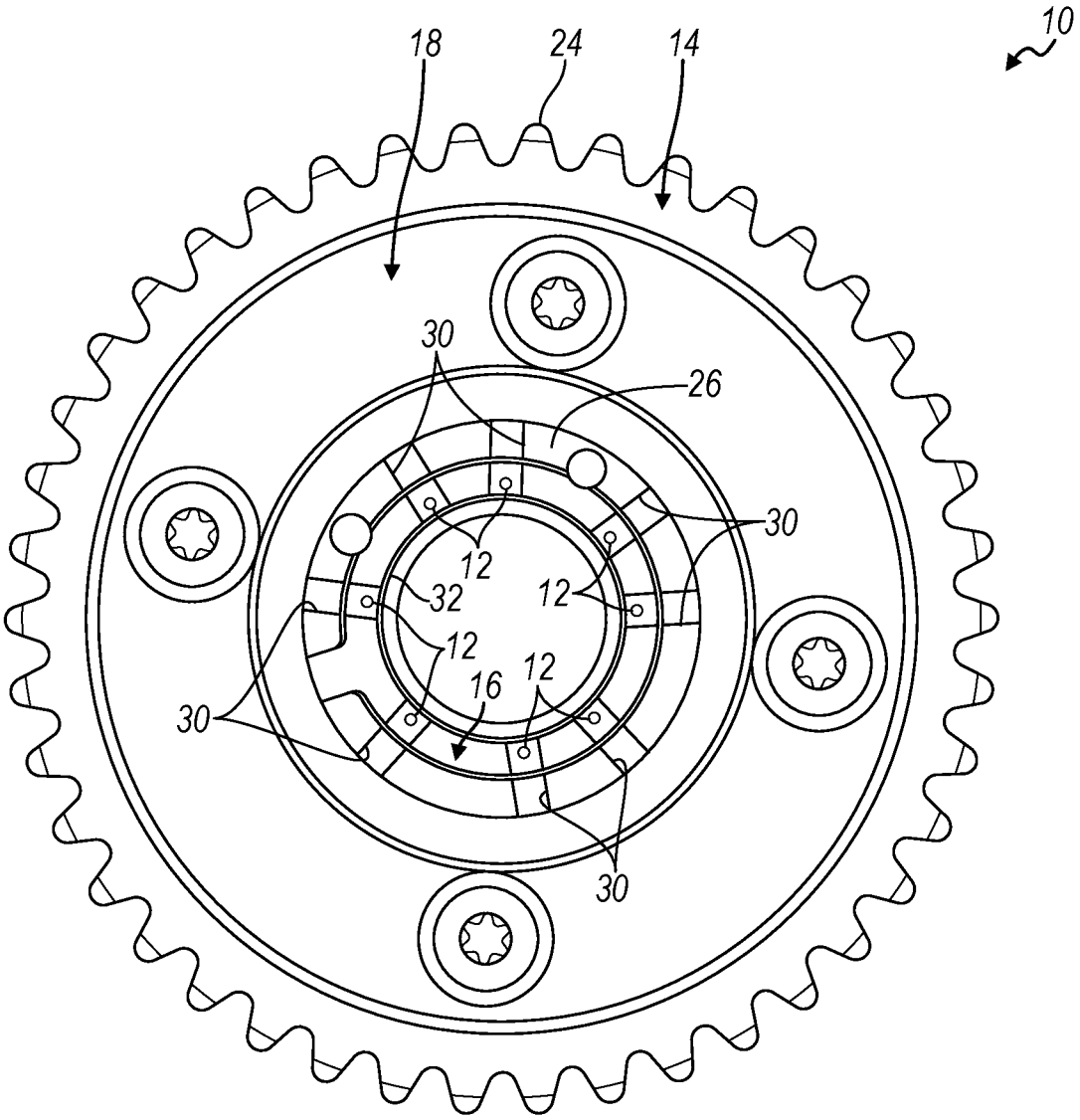
FIG. 6 depicts the rear view of the third embodiment, with the rotor being partially transparent for demonstrative purposes.
Figure 7:
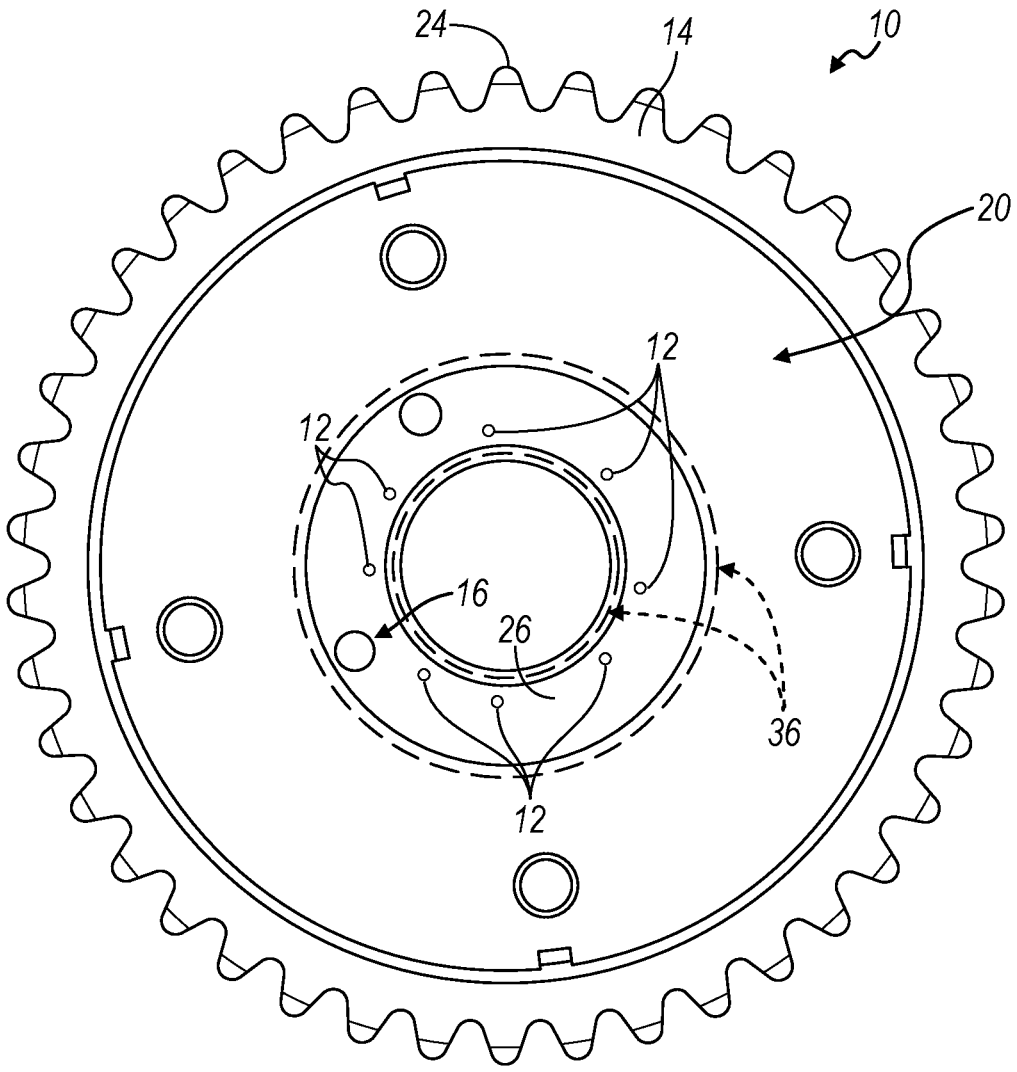
FIG. 7 depicts a front view of the third embodiment.

FIGS. 5-7 present a third embodiment of the VCT phaser assembly 10 with air venting and the air vents 12. Much of the description of the air vents 12 of the first embodiment fully applies here in the third embodiment, and may not be repeated. In the third embodiment multiple individual air vents 12 reside in the rotor 16 and particularly reside in the hub 26. The air vents 12 span wholly through the structure of the hub 26 in the axial direction relative to the generally circular shape of the hub 26. There is a total of eight individual air vents 12—a single air vent 12 intersecting and fluidly communicating with each port 30. Each air vent 12 in this embodiment is arranged at an orthogonal relationship with respect to its respective port 30 (i.e., the ports 30 are directed radially and the air vents 12 are directed axially). The orthogonal relationship has been shown to suitably effect air removal from the oil. The exact quantity of individual air vents can vary depending on the anticipated mixture of air in oil and the desired degree of venting for the particular VCT phaser assembly. Furthermore, in the third embodiment, the air vents 12 can be formed by laser drilling orifices in the hub 26, by drilling orifices in the hub 26, or by another preparation and formation technique.

As before, the precise size of the air vents 12 can vary and can depend on the anticipated mixture of air in oil and the desired degree of venting for the particular VCT phaser assembly. In one example, the air vents 12 can each have a diameter of approximately 0.10 mm. In other examples the air vents 12 can each have a diameter that ranges between approximately 0.1 mm and 0.5 mm, or that is less than approximately 0.5 mm in diameter. Still, in certain examples the air vents 12 can each have a total cross-sectional area ranging between approximately 0.01 $mm^2$ and 1.1 $mm^2$. Other values are possible for these dimensions. The air vents 12 are situated at a location that is suitable for effecting air removal from the oil and purging of air. In this third embodiment, the air vents 12 are located at the center of rotation region 36. The center of rotation region 36 is established here relative to the rotational motion of the VCT phaser assembly 10 and particularly relative to that of the hub 26, and is approximated and represented in FIG. 7 by the broken-line circles depicted. The center of rotation region 36 generally coincides with a radially-inboard region of the ports 30.

Figure 8:
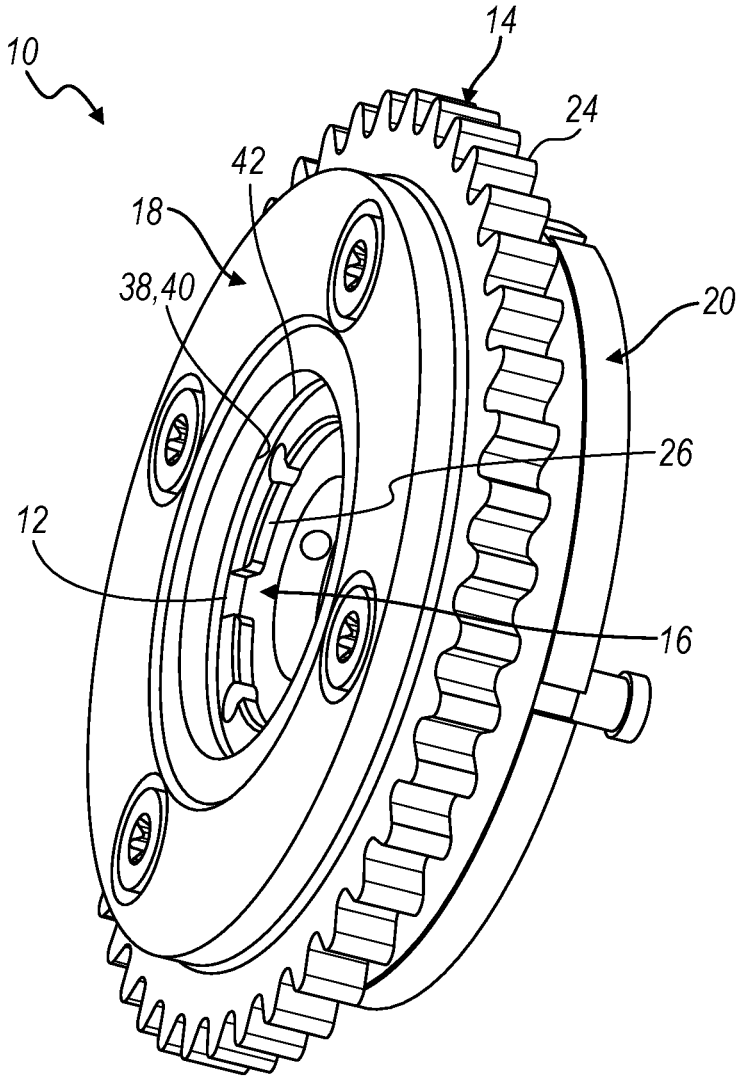
FIG. 8 depicts a perspective view of a fourth embodiment of the hydraulically-actuated VCT phaser assembly, this embodiment having an air vent in the form of a clearance between the inner plate and the rotor.

FIG. 8 presents a fourth embodiment of the VCT phaser assembly 10 with air venting and the air vents 12. Some of the description of the air vents 12 of the first embodiment fully applies here in the fourth embodiment, and may not be repeated. In the fourth embodiment, the air vent 12 is in the form of a clearance 38. The clearance 38 is established between the inner plate 18 and rotor 16 and, in particular, the clearance 38 is defined between the inner plate 18 and the hub 26 of the rotor 16. In this embodiment, the clearance 38 is a groove 40 that spans fully over a circumference of the inner plate 18. The groove 40 resides in the inner plate 18 itself and at a radially-inboard end 42 of the inner plate 18. The groove 40 fluidly communicates with all of the fluid chambers 34 at the center of rotation region 36. The center of rotation region 36 here is established relative to the rotational motion of the VCT phaser assembly 10 and relative to that of the inner plate 18, and has a similar location to that illustrated in FIG. 3 but includes the radially-inboard end 42. Due to the fluid communication with the fluid chambers 34, the groove 40 effects air removal from the oil and purging of air. In other embodiments, the clearance 38 could be multiple grooves established over certain sections of the circumference of the inner plate 18; the different grooves could then be in fluid communication with the fluid chambers 34. In this fourth embodiment, the groove 40 can have a crosswise extent measuring approximately 0.10 mm, ranging between approximately 0.1 mm and 0.5 mm, or that is less than approximately 0.5 mm. Still, other values are possible for this dimension. The groove 40 can be formed by a metalworking technique.

Figure 9:
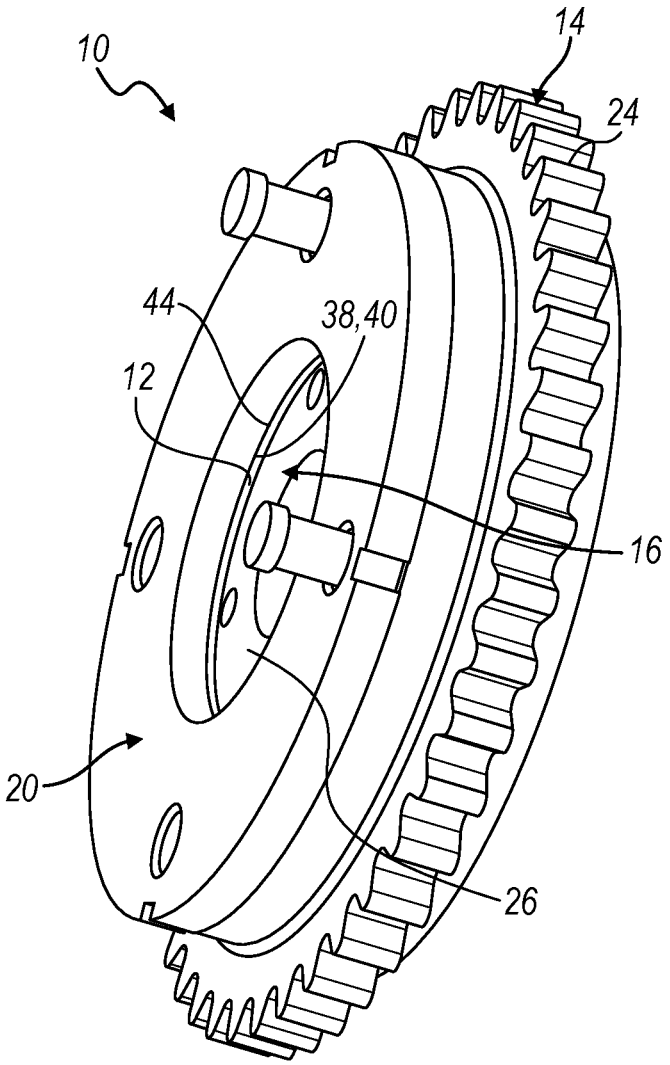
FIG. 9 depicts a perspective view of a fifth embodiment of the hydraulically-actuated VCT phaser assembly, this embodiment having an air vent in the form of a clearance between the outer plate and the rotor.

FIG. 9 presents a fifth embodiment of the VCT phaser assembly 10 with air venting and the air vents 12. Some of the description of the air vents 12 of the first embodiment fully applies here in the fifth embodiment, and may not be repeated. In the fifth embodiment, the air vent 12 is in the form of the clearance 38. The clearance 38 is established between the outer plate 20 and rotor 16 and, in particular, the clearance 38 is defined between the outer plate 20 and the hub 26 of the rotor 16. In this embodiment, the clearance 38 is a groove 40 that spans fully over a circumference of the outer plate 20. The groove 40 resides in the outer plate 20 itself and at a radially-inboard end 44 of the outer plate 20. The groove 40 fluidly communicates with all of the fluid chambers 34 at the center of rotation region 36. The center of rotation region 36 here is established relative to the rotational motion of the VCT phaser assembly 10 and relative to that of the outer plate 20, and has a similar location to that illustrated in FIG. 1 but includes the radially-inboard end 44. Due to the fluid communication with the fluid chambers 34, the groove 40 effects air removal from the oil and purging of air. In other embodiments, the clearance 38 could be multiple grooves established over certain sections of the circumference of the outer plate 20; the different grooves could then be in fluid communication with the fluid chambers 34. In this fifth embodiment, the groove 40 can have a crosswise extent measuring approximately 0.10 mm, ranging between approximately 0.1 mm and 0.5 mm, or that is less than approximately 0.5 mm. Still, other values are possible for this dimension. The groove 40 can be formed by a metalworking technique.

Figure 10:
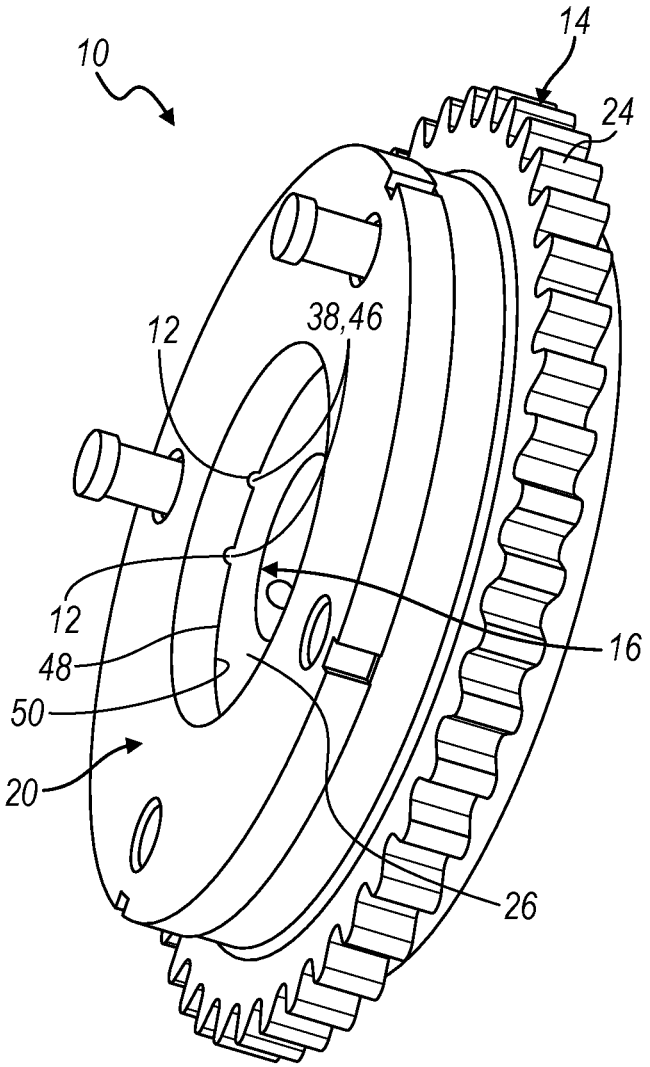
FIG. 10 depicts a perspective view of a sixth embodiment of the hydraulically-actuated VCT phaser assembly, this embodiment having air vents in the form of clearances between the outer plate and the rotor.
Figure 11:
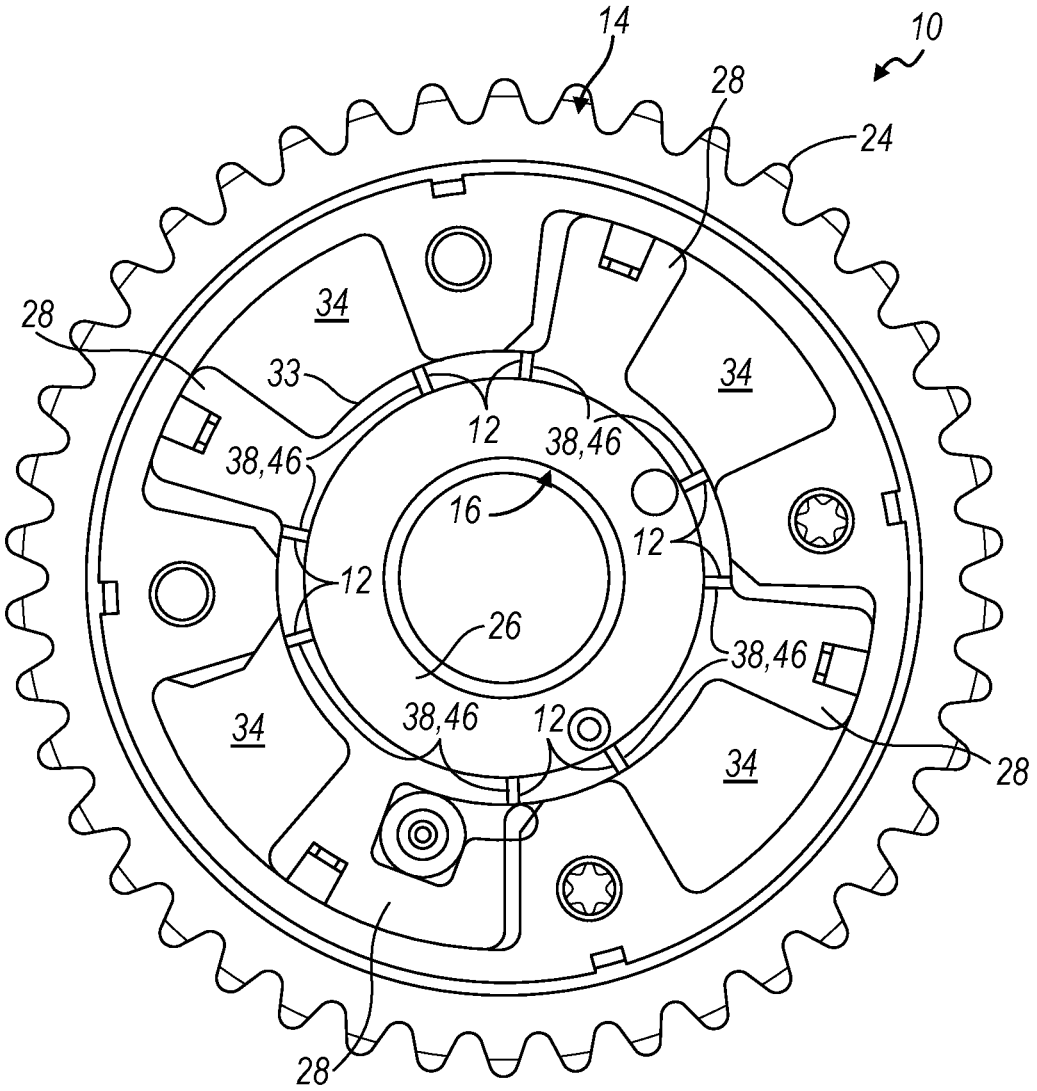
FIG. 11 depicts the sixth embodiment, with the outer plate being partially transparent for demonstrative purposes.

FIGS. 10 and 11 present a sixth embodiment of the VCT phaser assembly 10 with air venting and the air vents 12. Some of the description of the air vents 12 of the first embodiment fully applies here in the sixth embodiment, and may not be repeated. In the sixth embodiment, the air vent 12 is in the form of multiple clearances 38. The clearances 38 are established between the outer plate 20 and rotor 16 and, in particular, the clearances 38 are defined between the outer plate 20 and the hub 26 of the rotor 16. In this embodiment, the clearances 38 are multiple grooves 46 that span, in general, radially over a radially-inboard section of the outer plate 20. Each groove 46 spans from one of the fluid chambers 34 to an open radially-inboard end 48 of the outer plate 20 and ultimately to an exterior of the outer plate 20. The grooves 46 reside in the outer plate 20 and at an axially-inboard face 50 of the outer plate 20. At their locations, the grooves 46 are located at the center of rotation region 36 relative to the outer plate 20. The center of rotation region 36 in this sixth embodiment is similar to that described with reference to the fifth embodiment. The grooves 46 are defined in part by the confronting surfaces of the outer plate 20 and the hub 26 of the rotor 16. As perhaps demonstrated best by FIG. 10, the grooves 46 have a half-circle shape in this embodiment. Further, there is a total of eight individual grooves 46—two fluidly communicating with each fluid chamber 34, one with the advance fluid chamber side and one with the retard fluid chamber side. The exact quantity of individual grooves 46 can vary depending on the anticipated mixture of air in oil and the desired degree of venting for the particular VCT phaser assembly. In this sixth embodiment, the grooves 46 can have a crosswise extent measuring approximately 0.10 mm, ranging between approximately 0.1 mm and 0.5 mm, or that is less than approximately 0.5 mm. Still, other values are possible for this dimension. The grooves 46 can be formed by a metalworking technique.

In yet another embodiment, the air vent(s) 12 can reside in the center bolt body 22 of FIG. 1. Some of the description of preceding embodiments fully applies here for this embodiment, and may not be repeated. The air vent(s) 12 can span wholly through the structure of the center bolt body 22 in the radial direction relative to the generally cylindrical shape of the center bolt body 22. As before, the air vent(s) 12 can fluidly communicate with ports and/or other passages defined in the center bolt body 22. Air in oil traveling via the ports and/or passages of the center bolt body 22 can hence be removed via the air vent(s) 12. Similarly, the exact quantity of individual air vents in this embodiment can vary depending on the anticipated mixture of air in oil and the desired degree of venting for the particular VCT phaser assembly. Furthermore, in this embodiment, the air vent(s) 12 can be formed by laser drilling orifices in the center bolt body 22, by drilling orifices in the center bolt body 22, or by another preparation and formation technique. Likewise, as before, the precise size of the air vent(s) 12 can vary and can depend on the anticipated mixture of air in oil and the desired degree of venting for the particular VCT phaser assembly. In one example, the air vent(s) 12 can each have a diameter of approximately 0.10 mm. In other examples the air vent(s) 12 can each have a diameter that ranges between approximately 0.1 mm and 0.5 mm, or that is less than approximately 0.5 mm in diameter. Still, in certain examples the air vent(s) 12 can each have a total cross-sectional area ranging between approximately 0.01 $mm^2$ and 1.1 $mm^2$. Other values are possible for these dimensions. However sized, the air vent(s) 12 are situated at a location that is suitable for effecting air removal from the oil and purging of air.

Still, other embodiments of the VCT phaser assembly 10 with air venting and the air vent(s) 12 are possible, including embodiments that combine one or more the venting embodiments described above and depicted in the figures. For example, the air vents 12 can reside in both of the outer plate 20 and the inner plate 18 of the first and second embodiments.

It is to be understood that the foregoing is a description of one or more embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. A hydraulically-actuated variable camshaft timing (VCT) phaser assembly, comprising:

a housing, a rotor situated within the housing, a first plate situated on a first side of the housing and rotor, a second plate situated on a second side of the housing and rotor, and a center bolt body; and at least one air vent located at a center of rotation region of the at least one of the housing, rotor, first plate, second plate, or center bolt body, the center of rotation region being relative to rotational motion of the hydraulically-actuated VCT phaser assembly, wherein air brought to the center of rotation region during use and received in the at least one air vent escapes hydraulic fluid remaining in the hydraulically-actuated VCT phaser assembly, wherein a plurality of chambers is established among the housing, rotor, first plate, and second plate, and the at least one air vent is at least one clearance established between at least one of the first or second plate and a hub of the rotor and at a confrontation thereof, the at least one clearance being in direct fluid communication with the plurality of chambers.

2. The hydraulically-actuated variable camshaft timing (VCT) phaser assembly as set forth in claim 1, wherein a plurality of chambers is established between the housing and the rotor, the center of rotation region is located at the plurality of chambers and adjacent a hub of the rotor.

3. The hydraulically-actuated variable camshaft timing (VCT) phaser assembly as set forth in claim 1, wherein the at least one clearance is a groove residing in at least one of the first or second plate and spanning over at least a section of a circumference of the at least one of the first or second plate.

4. The hydraulically-actuated variable camshaft timing (VCT) phaser assembly as set forth in claim 1, wherein the at least one clearance is a plurality of grooves residing in at least one of the first or second plate and spanning generally radially from an exterior of the at least one of the first or second plate and to the plurality of chambers.

5. A hydraulically-actuated variable camshaft timing (VCT) phaser assembly, comprising:

a housing, a rotor, a plurality of chambers established between the housing and the rotor, a first plate situated on a first side of the plurality of chambers, and a second plate situated on a second side of the plurality of chambers; and a plurality of air vents residing in at least one of the first plate or the second plate, the plurality of air vents being in direct fluid communication with the plurality of chambers and located adjacent a hub of the rotor, wherein air separated from hydraulic fluid in the plurality of chambers during use of the hydraulically-actuated VCT phaser assembly and received in the plurality of air vents exits the plurality of chambers.

6. The hydraulically-actuated variable camshaft timing (VCT) phaser assembly as set forth in claim 5, wherein at least some of the plurality of air vents are located at corner regions of the plurality of chambers.

7. The hydraulically-actuated variable camshaft timing (VCT) phaser assembly as set forth in claim 5, wherein at least some of the plurality of air vents span in a general axial direction through the at least one of the first plate or the second plate.

8. The hydraulically-actuated variable camshaft timing (VCT) phaser assembly as set forth in claim 5, wherein the at least one air vent is a plurality of drilled orifices or a plurality of laser-drilled orifices.

9. The hydraulically-actuated variable camshaft timing (VCT) phaser assembly as set forth in claim 5, wherein the plurality of air vents resides at a circumferential and radial location on the at least one of the first plate or second plate to fluidly communicate with at least one of the plurality of chambers.

10. The hydraulically-actuated variable camshaft timing (VCT) phaser assembly as set forth in claim 5, wherein the plurality of air vents is located at a center of rotation region of the at least one of the first plate or the second plate, the center of rotation region being relative to rotational motion of the hydraulically-actuated VCT phaser assembly.

11. A hydraulically-actuated variable camshaft timing (VCT) phaser assembly, comprising:

a housing, a rotor with a hub, a plurality of chambers established between the housing and the rotor, a plurality of ports residing in the hub and fluidly communicating with the plurality of chambers for entry and exit of hydraulic fluid in and out of the plurality of chambers amid use of the hydraulically-actuated VCT phaser assembly, a first plate situated on a first side of the plurality of chambers, and a second plate situated on a second side of the plurality of chambers; and a plurality of air vents residing in the hub of the rotor, the plurality of air vents being in direct fluid communication with at least some of the plurality of ports, wherein air separated from hydraulic fluid in the hydraulically-actuated VCT phaser assembly during use and received in the plurality of air vents exits the plurality of ports via the plurality of air vents.

12. The hydraulically-actuated variable camshaft timing (VCT) phaser assembly as set forth in claim 11, wherein at least some of the plurality of vents span in a general axial direction through the hub.

13. The hydraulically-actuated variable camshaft timing (VCT) phaser assembly as set forth in claim 11, wherein at least some of the plurality of vents span in a direction that is generally orthogonal to a direction of the plurality of ports.

* * * * *